US007802844B1

(12) United States Patent
Vencill

(10) Patent No.: US 7,802,844 B1
(45) Date of Patent: Sep. 28, 2010

(54) COLLAPSIBLE INCLEMENT WEATHER CHAIR

(75) Inventor: Charles T. Vencill, 44 Tin Top Rd., Grant, AL (US) 35747-8608

(73) Assignee: Charles T. Vencill, Grant, AL (US)

( * ) Notice: Subject to any disclaimer, the term of this patent is extended or adjusted under 35 U.S.C. 154(b) by 0 days.

(21) Appl. No.: 11/063,679

(22) Filed: Feb. 23, 2005

Related U.S. Application Data

(60) Provisional application No. 60/546,870, filed on Feb. 23, 2004.

(51) Int. Cl.
*A47C 29/00* (2006.01)
*A47C 4/00* (2006.01)
*A47G 9/08* (2006.01)

(52) U.S. Cl. ..... 297/184.14; 297/16.2; 5/413 R

(58) Field of Classification Search ..... 297/184.1, 297/184.13, 184.14, 219.1, 219.12, 16.2, 297/465; 2/69, 69.5; 296/81; 5/413 R, 494
See application file for complete search history.

(56) References Cited

U.S. PATENT DOCUMENTS 751,452 A * 2/1904 Bird ..... 296/81
2,691,410 A 10/1954 Boucher
2,811,977 A 11/1957 McClish
3,124,387 A 3/1964 Maclaren
3,136,272 A 6/1964 Sprigman
3,443,066 A * 5/1969 Weibel ..... 219/527
3,509,891 A * 5/1970 Bolt ..... 135/148
3,580,633 A * 5/1971 Du Priest ..... 297/184.1
3,635,520 A 1/1972 Roher et al.
3,798,676 A * 3/1974 Shanks et al. ..... 2/69.5
3,835,471 A * 9/1974 Lankford ..... 2/84
4,015,778 A 4/1977 Chen et al.
4,083,601 A 4/1978 McBeth
4,188,988 A 2/1980 Agyagos
4,534,065 A 8/1985 Comfort
4,826,242 A * 5/1989 Trethewey ..... D6/611
4,846,528 A * 7/1989 Beier ..... 297/465
4,897,885 A * 2/1990 Lunt ..... 2/69.5
4,949,887 A 8/1990 Holmes
5,154,473 A 10/1992 Joranco
5,217,034 A 6/1993 Yih et al.
5,241,706 A 9/1993 Netz
5,287,872 A 2/1994 Anderson
5,368,057 A * 11/1994 Lubkeman et al. ..... 135/133
5,414,881 A 5/1995 Terrazas
5,427,834 A 6/1995 Sodetz
5,471,767 A 12/1995 Walker
5,657,489 A 8/1997 Ponstein
5,819,343 A 10/1998 Zampirri, Jr. et al.
5,882,068 A 3/1999 Levine
5,887,301 A 3/1999 Anderson (Continued)

*Primary Examiner*—David Dunn
*Assistant Examiner*—Tania Abraham
(74) *Attorney, Agent, or Firm*—Stites & Harbison PLLC; Richard S. Myers, Jr.

(57) ABSTRACT

An integrated inclement weather garment and chair having a removably mounted garment system designed so as to provide the user improved protection from the elements while providing a lightweight, portable, and stable resting platform. Embodiments of the garment system envelop at least a portion of the user in a protective material, the present invention providing comfort and warmth while allowing freedom of movement necessary to accommodate a variety of outdoor activities including sports spectating, concert events and demonstrations, hunting, fishing, wildlife observation, and other activities.

14 Claims, 3 Drawing Sheets

U.S. PATENT DOCUMENTS

| | | | | |
|---|---|---|---|---|
| 5,893,605 | A | 4/1999 | Chang | |
| 5,921,621 | A | 7/1999 | Cook et al. | |
| 5,956,766 | A * | 9/1999 | Benway | 2/69 |
| 5,961,178 | A | 10/1999 | Hodson | |
| 5,979,434 | A | 11/1999 | Bilanzich | |
| 6,012,189 | A * | 1/2000 | Dudley | 5/655 |
| 6,045,177 | A | 4/2000 | Grace | |
| 6,056,172 | A | 5/2000 | Welsh | |
| 6,109,256 | A | 8/2000 | Sardi | |
| D432,325 | S | 10/2000 | Zheng et al. | |
| 6,134,718 | A * | 10/2000 | Sesselmann | 2/243.1 |
| D433,244 | S | 11/2000 | Zheng | |
| 6,149,238 | A | 11/2000 | Tsai | |
| 6,179,374 | B1 | 1/2001 | Tang | |
| 6,209,951 | B1 * | 4/2001 | Han | 297/45 |
| 6,223,367 | B1 | 5/2001 | French et al. | |
| 6,264,271 | B1 * | 7/2001 | Munn et al. | 297/45 |
| 6,272,683 | B1 * | 8/2001 | Symms et al. | 2/69.5 |
| 6,296,002 | B1 | 10/2001 | Tashchyan | |
| 6,322,138 | B1 | 11/2001 | Tang | |
| 6,347,406 | B1 * | 2/2002 | Jones et al. | 2/69 |
| 6,367,083 | B1 | 4/2002 | November | |
| 6,393,637 | B1 | 5/2002 | Hoffman | |
| 6,408,462 | B1 | 6/2002 | Moore | |
| D460,280 | S | 7/2002 | Fox | |
| 6,454,348 | B1 | 9/2002 | Wu | |
| 6,547,322 | B2 | 4/2003 | Marx | |
| 6,547,324 | B1 | 4/2003 | Ammann, Jr. | |
| 6,550,855 | B2 | 4/2003 | Liu | |
| 6,601,912 | B1 * | 8/2003 | Chen | 297/45 |
| 6,629,722 | B1 | 10/2003 | Tang | |
| 6,655,735 | B1 * | 12/2003 | Learning | 297/228.1 |
| 6,764,134 | B1 * | 7/2004 | Crescenzi et al. | 297/219.12 |
| 6,926,355 | B2 * | 8/2005 | Le Gette et al. | 297/16.2 |
| 2002/0043822 | A1 | 4/2002 | Choi et al. | |
| 2002/0069904 | A1 * | 6/2002 | Robinson | 135/87 |
| 2002/0112752 | A1 | 8/2002 | Blakney | |
| 2003/0034674 | A1 * | 2/2003 | Gibson et al. | 297/4 |
| 2003/0061659 | A1 | 4/2003 | Dunlap et al. | |
| 2003/0117001 | A1 | 6/2003 | Gengler | |
| 2004/0217633 | A1 * | 11/2004 | Kassai et al. | 297/219.12 |

* cited by examiner

COLLAPSIBLE INCLEMENT WEATHER CHAIR

PRIORITY INFORMATION

This application claims priority to U.S. Application 60/546,870, file Feb. 23, 2004, now abandoned, the contents of which are incorporated herein by reference.

BACKGROUND OF THE INVENTION

1. Field of the Invention

This invention relates generally to the fields of personal comfort and portable spectator chairs. More specifically, embodiments of the present invention relate to protecting participants involved in sedentary outdoor activities from exposure to wind, precipitation (i.e., rain, sleet, snow), and cold temperature. Outdoor activities contemplated in connection with the present invention include, but are not limited to, outdoor activities such as sports spectating (i.e., baseball, soccer, rugby, football, etc.) concert events and demonstrations, hunting, fishing, wildlife observation and photography, camping, tailgating, etc.

2. Description of Related Art

The outdoor sports spectator, concert goer, hunter, fisher, wildlife observer or photographer, tailgater, camper, and otherwise outdoor enthusiast, continuously expose themselves to the elements. Many of these outdoor activities require or include long periods of sedentary periods which benefit from a comfortable resting platform or seat. The position of the participant involved in these activities can be on a rigid bench, bleacher, or fixed seat as is common at collegian and professional sporting events, on the ground, which is common at concerts and large demonstrations, or in portable seats and chairs, as is common in fishing, certain types of hunting, and when viewing amateur sporting events such as soccer, baseball, football, etc.

Individuals participating in sedentary outdoor pursuits have to endure a variety of comfort and climatic conditions. This becomes a greater challenge during inclement weather where wind, cold, and precipitation can drastically and detrimentally affect the individual. Cold and precipitation are the two greatest environmental stresses confronting the outdoor enthusiast. Creating a comfortable seating environment has been a challenge addressed by all outdoor enthusiasts. The minimum inclement weather implements employed by spectators using fixed or rigid seating are: the classic stadium cushion, pad or seat, umbrella, raincoat or poncho, and blanket or sleeping bag. Organizing, carrying, and arranging these implements can be challenging especially for the elderly and physically impaired since it is often required that participants walk extended distances between their vehicle or other transportation and their ultimate seat. Numerous attempts have been made to combine and improve the performance of implements used by enthusiasts participating in outdoor activities were fixed rigid seating is provided. Holmes (U.S. Pat. No. 4,949,887) describes an insulated multi-use seat cushion with closable hand and foot openings while Netz (U.S. Pat. No. 5,241,706) describes a combination hand muffler and seat warmer the contents both of which are incorporated herein in their entireties. Walker (U.S. Pat. No. 5,471,767), the contents of which is incorporated herein in its entirety, describes a body warming device that can be used to warm either the feet or hands during a variety of sedentary activities. Hodson (U.S. Pat. No. 5,961,178), Sardi (U.S. Pat. No. 6,109,256), and Gibson (U.S. Pat. Application No. 2003/0034674), the contents all of which are incorporated herein in their entireties, describe various configurations of stadium cushions, pads, and seats incorporating support mechanisms and storage, supplemental heating, and an integrated seat cushion with built-in leg warmer.

Outdoor enthusiasts have gone to great extremes to create comfortable microenvironments in response to changing and often times inclement weather conditions. Agyagos (U.S. Pat. No. 4,188,988) describes a sheet assembly for use as a multipurpose tote bag, Comfort (U.S. Pat. No. 4,534,065) describes a blanket/comforter designed to be wrapped around one's legs, Yih (U.S. Pat. No. 5,217,034) describes a personal tent system that offers warmth and rain resistance, Terrazas (U.S. Pat. No. 5,414,881) describes a combination stadium blanket and cushion that offers rain protection, Sodetz (U.S. Pat. No. 5,427,834) describes a versatile waterproof blanket composite, Ponstein (U.S. Pat. No. 5,657,489) describes a blanket device comprising a rectangular panel having openings for the head and or hands, Zampirri (U.S. Pat. No. 5,819,343) describes a multi-purpose combination blanket and tote bag, Anderson (U.S. Pat. No. 5,887,301) describes a convertible blanket and carrier, while French (U.S. Pat. No. 6,223,367) describes an improved stadium blanket that includes an integrated storage bag, November (U.S. Pat. No. 6,367,083), Hoffman (U.S. Pat. No. 6,393,637), and Moore (U.S. Pat. No. 6,408,462) all describe improved multipurpose blankets and personal covers, while Dunlap (U.S. Pat. Application No. 2003/0061659) describes an improved stadium blanket with integrated hand and feet warmers. The above listed patents and applications, the contents all of which are incorporated herein in their entireties, attempt to offer improvements to traditional blankets and personal covers some of which additionally address improvements in convenience by incorporating various folding and carrying mechanisms. None of the above mentioned art addresses the mutual need for a comfortable microenvironment and resting platform or seat while involved with sedentary outdoor activities.

The proliferation of amateur sports, especially those involving children, has greatly expanded the need for playing fields and sports complexes. With physical space at a premium, many sports complexes have elected to limit the availability of fixed seating options such as grandstands thus requiring spectators to supply their own portable seating. Folding chairs have been in common use for many years for both indoor and outdoor activities. Outdoor activities often times require the participant to travel moderate to lengthy distances from their primary vehicle to their ultimate location or position. This distance can be only a few yards for an amateur sporting event to literally miles for the sports of hunting, fishing, and wildlife observation and photography. The need for convenience, portability, and comfort in portable seating has stirred a multitude of products and inventions from the early 1950's to modern day. Boucher (U.S. Pat. No. 2,691,410), Maclaren (U.S. Pat. No. 3,124,387), (Sprigman (U.S. Pat. No. 3,136,272), and Roher (U.S. Pat. No. 3,635,520), the contents all of which are incorporated herein in their entireties, describe the earliest versions of collapsible portable seats and chairs. Designed to be self collapsing facilitating easy portability, these were valuable improvements over ridge two dimensionally collapsible chairs. Chen (U.S. Pat. No. 4,015,778), Levin (U.S. Pat. No. 5,882,068), Chang (U.S. Pat. No. 5,893,605), Grace (U.S. Pat. Nos. 6,045,171; 5,779,314), Cook (U.S. Pat. No. 5,921,621), Welsh (U.S. Pat. No. 6,056,172), Zheng (U.S. Pat. No. Des. 432,325), Zheng (U.S. Pat. No. Des. 433,244), Tsai (U.S. Pat. No. 6,149,238), Tang (U.S. Pat. Nos. 6,179,374 & 6,322,138), Han (U.S. Pat. No. 6,209,951), Munn (U.S. Pat. No. 6,264,271), Fox (U.S. Pat. No. Des. 460,280), Wu (U.S. Pat.

No. 6,454,348), Marx (U.S. Pat. No. 6,547,322), Ammann (U.S. Pat. No. 6,547,324), Liu (U.S. Pat. No. 6,550,855), Chen (U.S. Pat. No. 6,601,912), Choi (U.S. Pat. Application No. 2002/0043822), and Gengler (U.S. Pat. Application No. 2003/0117001), the contents all of which are incorporated herein in their entireties, all describe various modern and improved configurations of portable foldable and/or collapsible chairs. Grace and Chang are exemplary descriptions of what has become the industry standard for portable, three dimensionally collapsible chairs.

Significant improvements have been made in the portability and functionality of modern collapsible chairs. However, the need still exists for an improved multifunctional resting platform and inclement weather garment for use by those involved in sedentary outdoor activities. Several attempts have been made to improve the inclement weather functionality of foldable and collapsible chairs, the contents all of which are included herein in their entireties, as described by McClish (U.S. Pat. No. 2,811,977) describes a collapsible tent shelter adapted for use during ice fishing and hunting in cold and inclement weather, McBeth (U.S. Pat. No. 4,083,601) describes a foul weather outdoor chair comprised of a lightweight collapsible shelter structure for use in ice fishing and other outdoor activities, Joranco (U.S. Pat. No. 5,154,473) describes a sun and windbreaker panel, Anderson (U.S. Pat. No. 5,287,872) describes a portable collapsible umbrella shelter for use at sporting events, Bilanzich (U.S. Pat. No. 5,979,434) describes a campers wind block and heat reflector, Tashchyan (U.S. Pat. No. 6,296,002) describes a lightweight collapsible enclosure adapted to fit around a folding chair, and Blankney (U.S. Pat. Application No. 2002/0112752) who describes a variation of a collapsible canopy frame for use over a folding chair. While some of the above mentioned devices offer protection to wind and precipitation, none adequately address the issue of exposure to cold temperatures since the enclosures and canopies leave a significant air gap around the user. The portable enclosures and canopies also introduce visibility issues of other participants at sporting events etc. since these may block their view.

None of the above-mentioned patents or patent applications disclose or suggest an integrated portable collapsible inclement weather garment and resting platform designed to accommodate the diverse needs of participants involved in outdoor activities such as sports spectating, hunting, fishing, wildlife observation and photography, camping, tailgating, etc. The present invention addresses the need for such a device.

SUMMARY OF THE INVENTION

The present invention provides for a novel integrated inclement weather garment and chair. Embodiments of the present invention include a removably mounted garment system designed so as to provide the user improved protection from the elements while providing a lightweight, portable, and stable resting platform. The garment system may comprise lower and upper body portions designed to maximize comfort and warmth while allowing the freedom of movement necessary to accommodate a variety of outdoor activities including sports spectating, concert events and demonstrations, hunting, fishing, wildlife observation, and other activities. The garment system may be self enveloping, thus allowing the garment to function as a cover and carrying mechanism. The garment may be constructed of various material composites designed to offer the desired insulative properties optionally including wateproofness, windproofness, and moisture vapor permeability.

DETAILED DESCRIPTION OF THE INVENTION

Several embodiments of the disclosed invention have been conceived to demonstrate the potential breadth and significance of the present invention. Inclusion of these embodiments in no way serves to limit the potential breath and applicability of the disclosed art to other configurations or uses.

As stated above, embodiments of the present invention include a foldable or collapsible chair that includes an inclement weather garment. The inclement weather garment helps protect the user from cold weather, wind, rain, etc.

Also, as indicated above, due to the popularity of collapsible chairs, there are many variations on the market and in the patent literature. The present invention can be used in connection with most, if not all, collapsible chair designs. The present invention can be adapted to the collapsible benches, or chairs that hold one or more persons. The chairs can be of the extendible and height adjustable variety, as well as those that incorporates various compartments or pockets, including drink holders.

Figure 1:
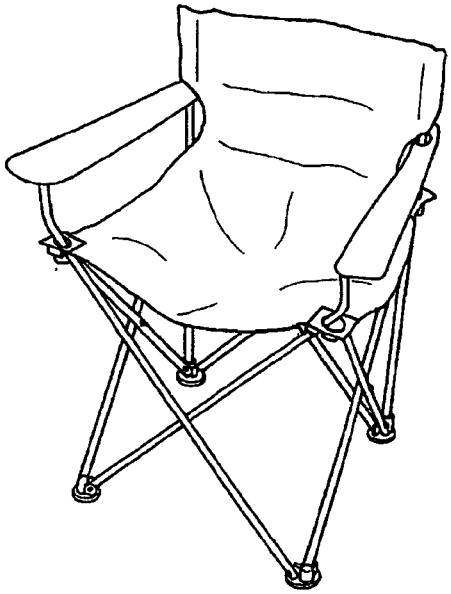
FIG. 1 (PRIOR ART)
FIG. 1 shows an example of a conventional foldable/collapsible chair.

A typical collapsible chair is shown in FIG. 1. Such a chair may comprise a leg assembly and a seat cloth. The leg assembly may comprise a plurality of rigid leg members hingedly connected together by a device such as a pivotal pin as well as being joined together by a joint member.

With the typical chair, the seat cloth is mounted on the leg assembly. When the leg assembly is opened, the leg assembly forms a chair frame and the seat cloth is also opened by the leg members to form a seat base. The leg members are usually made up of a rigid material such as metal tubes. Often the seat cloth is mounted onto the chair frame as to form a back support as well. The seat cloth is usually a piece of canvas or other synthetic fabric. The seat cloth may also serve to hold the leg members in place when a user is sitting in the chair.

Figure 2:
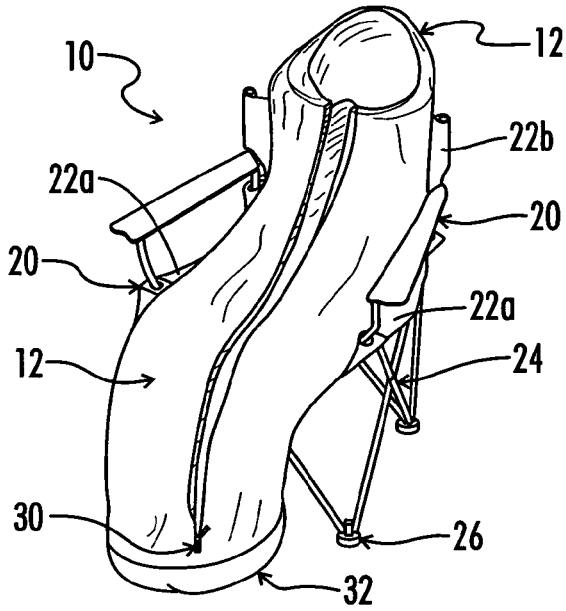
FIG. 2 shows a perspective view of a basic concept of an embodiments of the present invention, a novel integrated inclement weather garment and a resting platform device.

FIG. 2 shows a perspective view a basic embodiment of the integrated inclement weather garment and resting platform apparatus 10 of the present invention. This embodiment includes a garment system 12, and a collapsible frame, 20. In the simplest rendition, the frame also comprises a cloth 22 that supports a user by forming a seat 22*a* and a back 22*b*.

There are many options with respect to the construction of the garment. For example, the materials may vary greatly. Also, pockets or compartments can be incorporated into the garment.

In certain embodiments, the garment 12 is configured as a unitized body comprising upper and lower portions of interconnected panels made from a composite material. For example, it may be constructed from a variety of fabrics and materials such as cotton, wool, fleece, nylon, polyester, acrylic, synthetic and/or natural fiber blends, feather down, etc. The composite material can contain multiple layers thus offering protection from the cold as well as being windproof and/or waterproof. The composite can further be made moisture vapor permeable by the addition of one or more layers of microporous or monolithic breathable films, membranes and/or composites such as Hytrel®, Pebax®, Sympatex®, Goretex®, Aptra Classic®, Aptra® M, Propore®, Exxaire®, polyurethane, DuraVent®, and the like. Since the invention has application across a variety of outdoor activities a modular garment system can provide useful where the garment is constructed from multiple but separable layers that can be combined as needed based on climatic conditions. This type system is common in the garment industry as demonstrated in winter coats having removable zip out linings. The garment system may be constructed to snugly and comfortably envelop the wearer.

The garment may be made from a variety of materials, as determined by one of ordinary skill in the art. By way of an example, one such material is a composite material. This composite material may be designed to possess at least one of the following characteristics: resist air flow, be thermally insulative, and be substantially water impermeable. Additionally, the composite may be designed to include a moisture vapor permeable layer that is microporous or monolithic, or a combination thereof. This moisture vapor permeable may be selected from the group consisting on polyolefins, polyethylene, polypropylene, polytetrafluroethylene, polyester, polyamide, copolyether ester block copolymers and their blends, polyurethane, polyvinyl alcohol, and blends thereof.

Additionally, in certain embodiments, the composite can include an additive designed to adsorb human scents and odors. This additive may be selected from the group consisting of activated carbon, zeolites, chlorophyll, baking soda, activated alumina, soda lime, calcium oxide, and potassium permanganate, and blends thereof.

The garment system may also, for example, include at least one closure, 30, that facilitates doffing and doffing the garment. The closure system may have be a zipper, snaps, buttons, hook and loop, press to close, or other similar system. The closure can optionally include storm flaps and can be made liquid tight using more sophisticated closures as are common in the high end garment industry.

Additionally, the garment system can optionally include an abrasion resistant region 32 in the distal area of the garment. This area can be reinforced with abrasion and or slip resistant materials such as canvas, polyvinyl chloride, Cordura®, or similar material common to the garment industry.

The frame 20 shown in the figures is a standard, popular collapsible chair that is collapsible via a series of pivotal attachments such as 24, and 26. In the configuration shown, the garment system can be folded into the seat area of the device and the frame collapsed thus making a single unitized outdoor garment system and resting platform.

Figure 3:
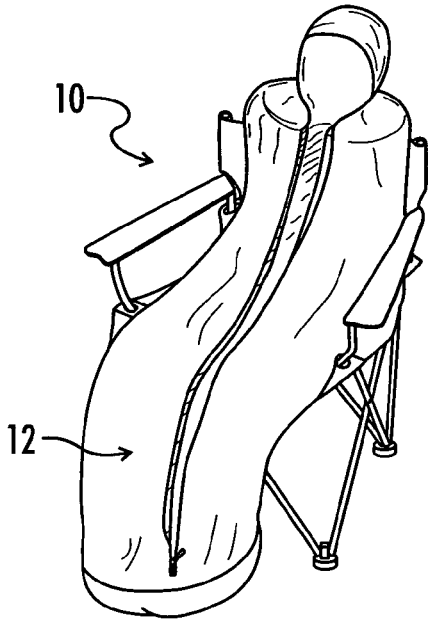
FIG. 3 shows an embodiment similar to the one shown in FIG. 2, with the additional feature of a hood incorporated into the garment.
Figure 4:
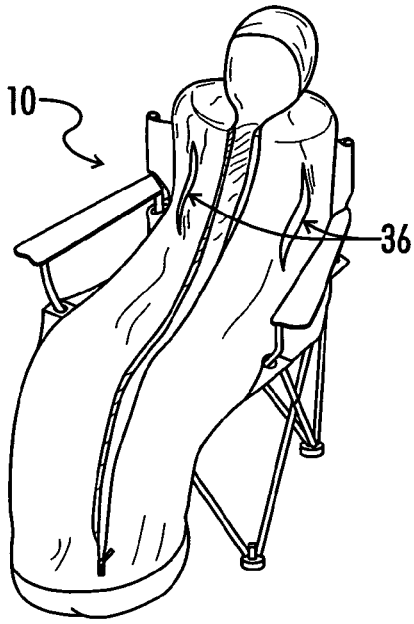
FIG. 4 shows an embodiment similar to the one shown in FIG. 3, with the additional feature of apertures to allow arms to be extended from the garment.
Figure 5:
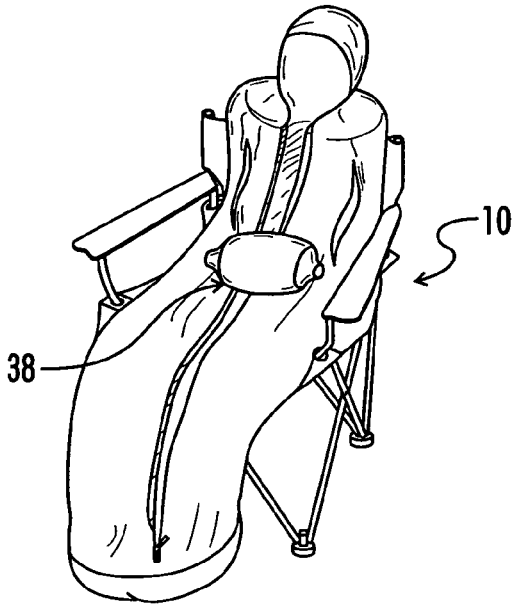
FIG. 5 shows an embodiment of the preset invention that includes a hand warmer.
Figure 6:
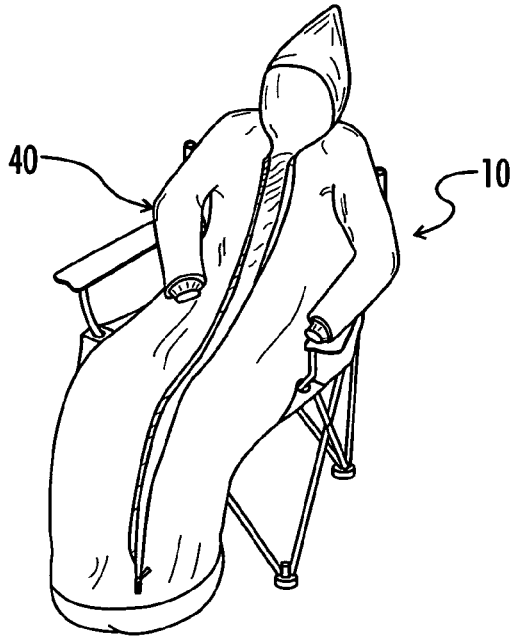
FIG. 6 shows an embodiment of the present invention that includes sleeves to receive the arms of a wearer.

FIG. 3 shows an optional removably attached hood. This hood can be constructed of a similar or different material than the body of the garment and can have various closure devices such as snaps, drawstrings, etc. common to the garment industry. FIG. 4 is a perspective view of the invention whereby the garment system include apertures 36, located in the upper peripheral area of the garment to facilitate freedom of movement allowing the hands and arms to be extended out of the garment. These apertures can be simple openings or more complex consisting of multiple panels to minimize wind from entering the garment. FIG. 4 shows and externally mounted hand warmer 38, that can be mounted internal or external of the apertures. While not shown, the garment system can also incorporate various sized and configure pouches internal and external to accommodate a variety of personal effects and paraphernalia and/or supplemental passive heating devices such as HotHands®. FIG. 6 is a perspective view of an embodiment that incorporates extended apertures or sleeves, 40, that provide the user the highest level of protection and freedom of movement. This configuration is especially well suited for hunting and fishing activities.

Figure 7:
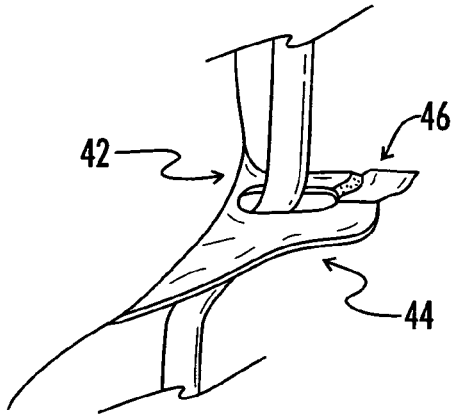
FIG. 7 shows an example of an attachment device that may be used in connection with the present invention to attach the garment to the collapsible chair frame.

The garment system may be integrated with the frame 20 in many ways. For example, it may be attached my way of multiple semi-positive attachment points. FIG. 7 is a perspective view of one embodiment. This attachment point 42 is configured such that the garment system can be removed from the device frame and laundered, repaired, or modified. This figures shows a circular attachment ring 44, having a hook and loop closure 46. Other type attachments such as hook and loop, ties, snaps, buttons, pivotable shaft/pin assembles, etc. are conceivable and common in the fastener industry but not shown. An advantage to this embodiment is that the garment can be removed and laundered.

In other embodiments, the garment system and/or frame can optionally be fitted with carrying straps and the device collapsed such that the garment is wrapped around the frame and secured thus creating a carrying mechanism. That is, the garment may be invertible to envelop the chair when the chair is in a collapsed state.

Figure 8:
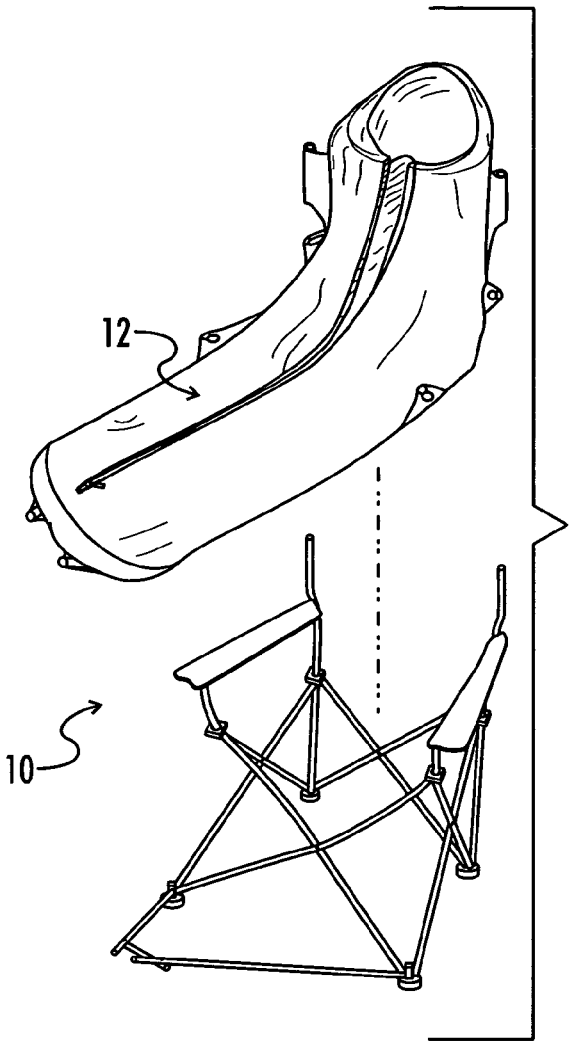
FIG. 8 shows an embodiment of the present invention where the garment attaches to the seat frame and performs as the seat and back support.
Figure 9:
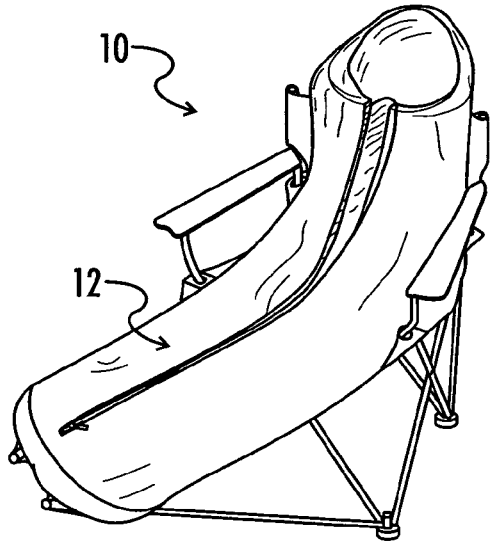
FIG. 9 shows an embodiment of the present invention where the collapsible chair frame includes a foot rest.

FIG. 8 shows an embodiment of the present invention where the garment itself functions as the chair seat part and back support part. In this embodiment, the garment attached to the frame. When donned by a wearer, it provides seat and back support. In this embodiment, the garment essentially functions as the seat base and back base to support a wearer when the collapsible seat is in an open position. This embodiment can be attached to the frame in a variety of manners, including by a hook and look mechanism as depicted in FIG. 7.

While the preset invention has been described in detail and pictorially shown in the accompanying drawings, such description should not be construed as limitations of the scope of the invention, but rather as an exemplification of preferred embodiments thereof. That is, it should be obvious that the subject patent is applicable to other embodiments that may include various configurations, fabrics, construction, attachment mechanisms, closures, etc. All such embodiments are considered to be part of the instant invention and not a departure therefrom.

I claim:

1. A collapsible chair, comprising:

a frame that includes at least four support legs with at least one support leg pivotally engaging a second leg so as to move the collapsible chair between an expanded position and a collapsed position, the support legs comprising a seat support frame when in the expanded position;

and coupled to said at least four support legs, a garment comprised of a flexible material sheet that forms a cavity, the cavity including seat portion and a back portion to support a seated occupant when the frame is in an expanded position, wherein the cavity substantially encloses and protects from outdoor elements a substantial portion of the torso and legs of the seat occupant, wherein the garment is invertible to envelope the chair for storing and transporting when the chair is in the collapsed position; and wherein the garment system is coupled to the at least four support legs via four attachment points.

2. The collapsible chair of claim 1, wherein the garment has an opening to facilitate the removal of the seat occupant's arm from within the cavity.

3. The collapsible chair of claim 1, wherein the attachment points are chosen from attachment rings, snaps, a hook and loop fastener, zipper, press to close.

4. The collapsible chair of claim 1, wherein the garment comprises at least one vapor permeable layer.

5. The collapsible chair of claim 1, wherein garment is comprised of a material composite that resists air flow, is thermally insulative, and is substantially water impermeable.

6. The collapsible chair of claim 5, wherein the composite includes a moisture vapor permeable layer that is selected from the group consisting of polyolefins, polyethylene, polypropylene, polytetrafluroethylene, polyester, polyamide, copolyether ester block copolymers and their blends, polyurethane, polyvinyl alcohol, and blends thereof.

7. The collapsible chair of claim 1, wherein the garment is comprised of a composite that is both substantially water impermeable and moisture vapor permeable.

8. The collapsible chair of claim 1 wherein the garment is comprised of a material composite that includes an additive designed to adsorb human scents and odors.

9. The collapsible chair of claim 8, wherein the additive is selected from the group consisting of activated carbon, zeolites, chlorophyll, baking soda, activated alumina, soda lime, calcium oxide, and potassium permanganate, and blends thereof.

10. The collapsible chair of claim 1, wherein the frame includes supports for a foot rest, and the garment rests upon the foot rest when the chair is in the expanded position.

11. The collapsible chair of claim 1, wherein the garment includes camouflaged-patterned indicia.

12. The collapsible chair of claim 1, wherein the attachment points include multiple semi-positive attachment points.

13. The collapsible chair of claim 1, wherein the attachment points include at least one of a hook and loop, tie, button, pivotable shaft/pin assembly.

14. The collapsible chair of claim 1, wherein the garment is removably integrated to the frame or seat support frame.

* * * * *